US008484861B2

(12) United States Patent
Park et al.

(10) Patent No.: US 8,484,861 B2
(45) Date of Patent: Jul. 16, 2013

(54) CLOTHES TREATING APPARATUS

(75) Inventors: Hye Yong Park, Changwon-si (KR); Jung Wook Moon, Changwon-si (KR); Seung Gyu Ryu, Changwon-si (KR); Chang Gyu Choi, Changwon-si (KR); Kwang Hee Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 573 days.

(21) Appl. No.: 12/733,028

(22) PCT Filed: Aug. 4, 2008

(86) PCT No.: PCT/KR2008/004512

§ 371 (c)(1),
(2), (4) Date: Feb. 3, 2010

(87) PCT Pub. No.: WO2009/020321

PCT Pub. Date: Feb. 12, 2009

(65) Prior Publication Data

US 2010/0132209 A1 Jun. 3, 2010

(30) Foreign Application Priority Data

Aug. 3, 2007 (KR) ..... 10-2007-0078123
May 14, 2008 (KR) ..... 10-2008-0044617
May 14, 2008 (KR) ..... 10-2008-0044622

(51) Int. Cl.
*F26B 19/00* (2006.01)

(52) U.S. Cl.
USPC ..... 34/201; 34/218; 34/601; 219/400; 392/385

(58) Field of Classification Search
USPC .... 34/201, 218, 601, 606, 610, 596; 219/386, 219/400; 392/384, 385; 68/5 R
See application file for complete search history.

(56) References Cited

U.S. PATENT DOCUMENTS

| | | | | |
|---|---|---|---|---|
| 3,866,336 | A * | 2/1975 | Bereza | 34/201 |
| 4,819,341 | A * | 4/1989 | Gayso | 34/86 |
| 5,152,077 | A * | 10/1992 | Liang | 34/77 |
| 5,755,040 | A * | 5/1998 | Ou | 34/202 |
| 6,005,227 | A * | 12/1999 | Pappas | 219/400 |
| 6,425,192 | B2 * | 7/2002 | Arrieta et al. | 34/486 |
| 6,845,569 | B1 * | 1/2005 | Kim | 34/106 |
| 7,377,052 | B2 * | 5/2008 | Maruca | 34/201 |
| 8,132,339 | B2 * | 3/2012 | Moon et al. | 34/601 |
| 2001/0020338 | A1 * | 9/2001 | Arrieta et al. | 34/202 |
| 2002/0195914 | A1 * | 12/2002 | Albaizar et al. | 312/314 |
| 2005/0115104 | A1 * | 6/2005 | Guinibert et al. | 34/601 |
| 2005/0166419 | A1 * | 8/2005 | Regelski | 34/202 |
| 2006/0137205 | A1 * | 6/2006 | Lee et al. | 34/60 |
| 2008/0136295 | A1 * | 6/2008 | Aizpuru Borda et al. | 312/31 |
| 2009/0151193 | A1 * | 6/2009 | Moon et al. | 34/621 |
| 2010/0058608 | A1 * | 3/2010 | Moon et al. | 34/282 |

FOREIGN PATENT DOCUMENTS

| | | | |
|---|---|---|---|
| DE | 33 43 236 | | 6/1985 |
| EP | 2105528 | A1 * | 9/2009 |
| JP | 2000225299 | A * | 8/2000 |
| JP | 2008-121145 | | 5/2008 |
| WO | WO 2008-013382 | | 1/2008 |

* cited by examiner

*Primary Examiner* — Steve M Gravini
(74) *Attorney, Agent, or Firm* — McKenna Long & Aldridge LLP

(57) ABSTRACT

A clothes treating apparatus is disclosed. The clothes treating apparatus includes a cabinet defining a accommodating space for receiving clothes, an air supplying device for drying air circulating into the accommodating space, and a guide unit for guiding dry air generated by the air supplying device to be uniformly dispersed into the accommodating space.

19 Claims, 8 Drawing Sheets

CLOTHES TREATING APPARATUS

This application is a National Stage Entry of International Application No. PCT/KR2008/004512, filed on Aug. 4, 2008, and claims priority to Korean Patent Application No. 10-2007-0078123, filed Aug. 3, 2007, Korean Patent Application No. 10-2008-0044617, filed May 14, 2008, Korean Patent Application No. 10-2008-0044622, filed May 14, 2008, each of which is hereby incorporated by reference in its entirety as if fully set forth herein.

TECHNICAL FIELD

The present invention relates to a clothes treating apparatus, and more particularly, to a clothes treating apparatus that is capable of uniformly dispersing hot air supplied into a space for receiving clothes.

BACKGROUND ART

Generally, clothes treating apparatuses are apparatuses that perform various works related to clothes. Specifically, the clothes treating apparatuses include various kinds of apparatuses that perform washing, drying, and other processes with respect to clothes, including clothes washing apparatuses for washing clothes and clothes drying apparatuses for drying wet clothes.

In recent years, there has been proposed a refreshing apparatus that performs a refreshing process to improve the state of clothes as well as a conventional clothes treating apparatus that performs washing and drying with respect to clothes.

The refreshing apparatus performs works to improve the general state of clothes, including the removal of wrinkles from the clothes through the supply of hot air or the removal of moisture from the clothes, after washing or wearing the clothes. In most cases, the clothes treating apparatus may generally include a hot air supplying device for supplying hot air to dry clothes or improve the state of the clothes.

DISCLOSURE OF INVENTION

Technical Problem

When hot air is discharged into a space for receiving clothes, however, the hot air is not uniformly dispersed in the clothes accommodating space but is supplied into the clothes accommodating space only in a specific direction.

As a result, it is not possible for the clothes treating apparatus to properly perform a drying or reproducing process with respect to the clothes received at positions where the hot air is not sufficiently supplied in the clothes accommodating space.

Technical Solution

The above problems can be solved by providing a clothes treating apparatus including a cabinet defining a accommodating space for receiving clothes, an air supplying device for drying air circulating into the accommodating space, and a guide unit for guiding dry air generated by the air supplying device to be uniformly dispersed into the accommodating space.

Preferably, the clothes treating apparatus further includes at least one supply hole formed at one side of the accommodating space for allowing the dry air to be supplied therethrough and a circulation duct communicating with the at least one supply hole to define a path along which hot air flows. Also, the at least one supply hole may be formed at each side or the rear of the accommodating space.

Preferably, the guide unit includes a plurality of guide ribs for horizontally dispersing the hot air flowing along the circulation duct through the at least one supply hole. Specifically, the guide ribs are disposed inside the circulation duct such that the guide ribs are adjacent to the at least one supply hole. Here, at least some of the guide ribs may be inclined at a predetermined angle to the direction in which the circulation duct is disposed. Also, at least some of the guide ribs may be disposed such that the distance between the neighboring guide ribs is increased.

Preferably, the clothes treating apparatus further includes a guide member for guiding the hot air flowing along the circulation duct to be supplied to the at least one supply hole. Here, the guide member may be disposed in the circulation duct such that the guide member is adjacent to the at least one supply hole, the guide member being bent toward the at least one supply hole.

Preferably, the guide unit includes a guide plate disposed in front of the at least one supply hole such that the guide plate is spaced a predetermine distance from the at least one supply hole, and hot air supplied through the at least one supply hole is dispersed into the accommodating space through a space defined between the guide plate and the inside of the accommodating space. Here, the guide plate may have a size greater than that of the at least one supply hole. Also, the guide plate may be parallel to the inside of the cabinet where the at least one supply hole is formed. Furthermore, the guide plate may be provided at one side thereof with a through-hole.

Preferably, the clothes treating apparatus further includes a sub plate spaced a predetermined distance from the through-hole of the guide plate, and hot air passing through the through-hole is dispersed into the accommodating space through a space defined between the guide plate and the sub plate. Here, the sub plate may be provided with a dispersing part for guiding the flow of the hot air passing through the through-hole.

Preferably, the clothes treating apparatus further includes a guide member for guiding the hot air flowing along the circulation duct to be supplied to the at least one supply hole.

Also, the cabinet is provided with a plurality of supply holes, and the guide unit includes a plurality of fixing plates disposed at the respective supply holes to uniformly supply the hot air through the plurality of supply holes.

Here, the fixing plates may be formed adjacent to the respective supply holes such that the fixing plates protrude inwardly of the circulation duct. Also, the fixing plates may have lengths different according to the distance between the fixing plates and the air supplying device along the circulation duct. That is, it is preferred for the lengths of the fixing plates to be increased with the increase in distance between the fixing plates and the air supplying device. Furthermore, the fixing plates may be fixed such that the fixing plates are inclined at a predetermined angle to the air supplying device.

Preferably, the clothes treating apparatus further includes a moisture supplying device for selectively supplying moisture into the accommodating space. Here, the moisture supplying device includes a steam generator for supplying steam into the accommodating space.

Advantageous Effects

The clothes treating apparatus according to the present invention is capable of supplying hot air into the space for receiving clothes while uniformly dispersing the hot air, thereby forming the same clothes treating environment irrespective of the positions of the clothes. Consequently, the present invention has the effect of preventing the clothes from being nonuniformly treated due to the nonuniform supply of the hot air.

Also, according to the present invention, it is possible to prevent the clothes from being directly exposed to high temperature, thereby preventing damage to the clothes.

Furthermore, it is possible to prevent the exposure of the discharge port through which the hot air is supplied, thereby providing an esthetically pleasing appearance to the clothes accommodating space.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. In the embodiments, the present invention is applied to a refreshing apparatus that supplies steam and hot air to clothes to improve the state of the clothes. However, the refreshing apparatus is merely an example, and therefore, the present invention is not limited to the refreshing apparatus. Consequently, it should be understood that the preset invention is applicable to all kinds of clothes treating apparatuses that supply hot air into a space for receiving the clothes.

Figure 1:
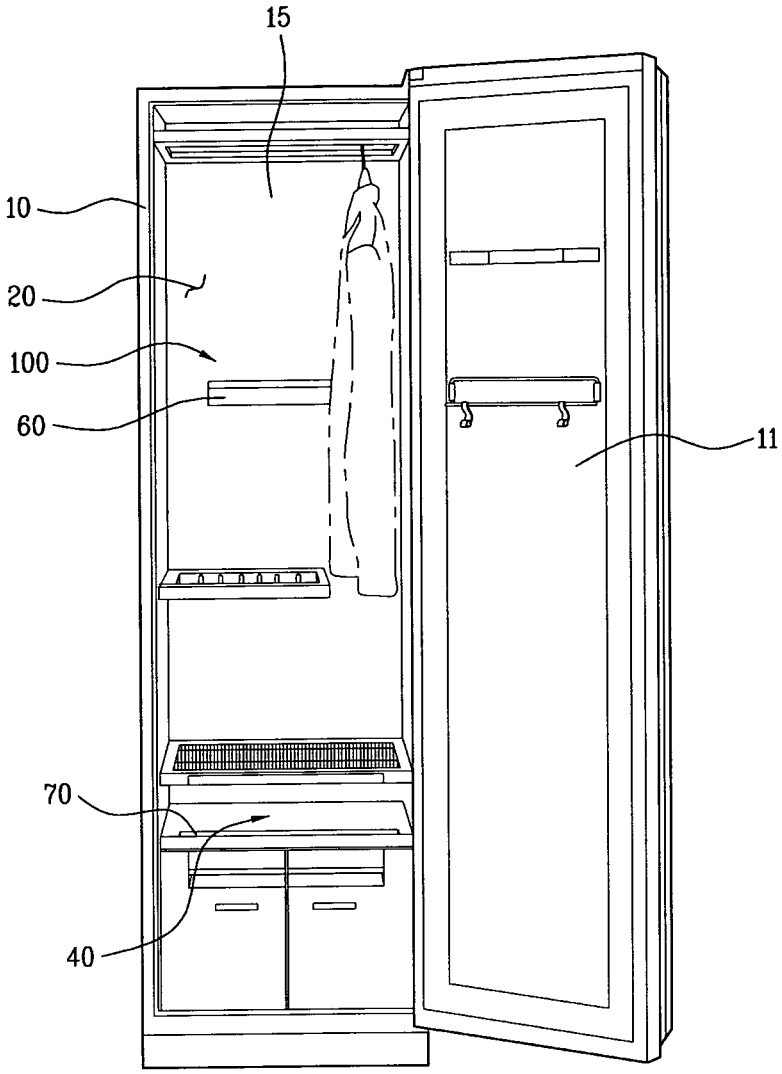
FIG. 1 is a front view illustrating a clothes treating apparatus according to a first embodiment of the present invention.
Figure 2:
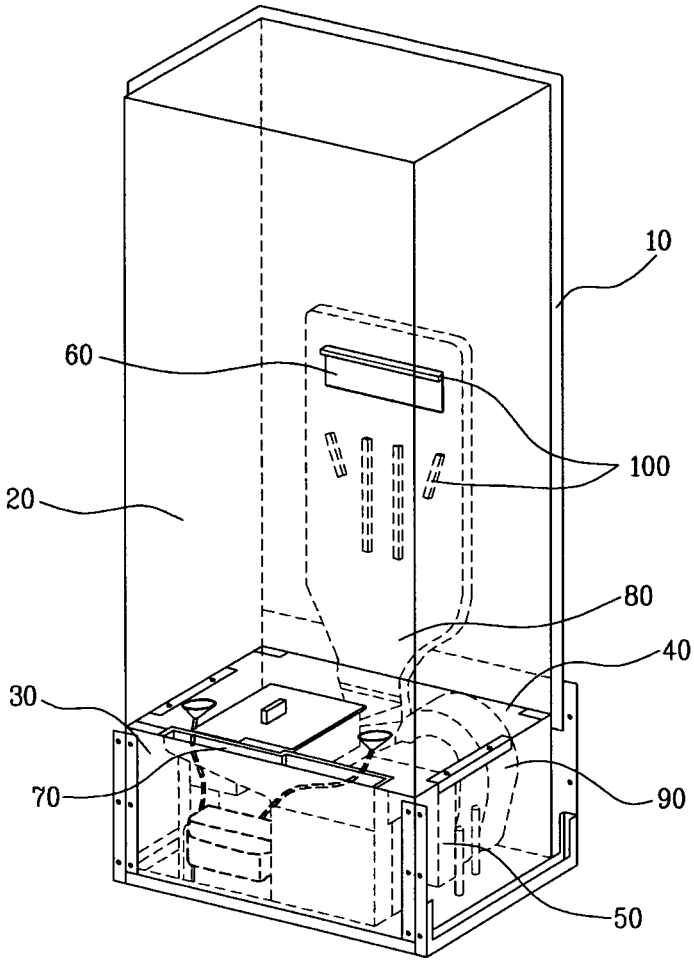
FIG. 2 is a perspective view illustrating the interior stricture of the clothes treating apparatus shown in FIG. 1.

FIG. 1 is a front view illustrating a clothes treating apparatus according to a first embodiment of the present invention, and FIG. 2 is a perspective view illustrating the interior structure of the clothes treating apparatus shown in FIG. 1.

Referring to FIGS. 1 and 2, a cabinet 10 forms the external appearance of the clothes treating apparatus, and a accommodating space 20 for receiving clothes to be refreshed is defined in the cabinet 10. Preferably, the cabinet 10 is constructed in a structure in which the front of the cabinet 10 is surrounded by a cover to hermetically seal the accommodating space 20. At one side of the cabinet 10 is mounted a door 11 which is opened and closed when clothes are received in the accommodating space 20. Also, various manipulation switches (not shown) for driving the clothes treating apparatus may be mounted at the outside of the cabinet 10.

In the clothes treating apparatus according to this embodiment, an air supplying device 50 is mounted in the cabinet 10 for supplying dry air into the accommodating space 20. The air supplying device 50 can supply the dry air into the accommodating space 20 using a heater or a thermoelectric element depending upon the capacity of the accommodating space 20. However, it is preferred to provide an air supplying device 50 that supplies hot air using a heat pump for supplying hot air and, at the same time, performing a dehumidifying function.

The air supplying device 50 applied to this embodiment is a heat pump, which is similar to a heat pump used in an air conditioner. That is, the air supplying device 50 includes an evaporator, a compressor, a condenser, and an expansion valve, through all of which a refrigerant circulates. In this case, the refrigerant is evaporated by the evaporator, with the result that the refrigerant absorbs latent heat from surrounding air. Consequently, the air is cooled, and moisture contained in the air is condensed and removed. Also, when the refrigerant passes through the compressor and is then condensed by the condenser, the refrigerant transmits latent heat to surrounding air, with the result that the surrounding air is heated. Consequently, the evaporator and the condenser function as a heat exchanger, and therefore, air passing through the air supplying device 50 is dehumidified and heated through the evaporator and the condenser.

Here, it is preferred for the air supplying device 50 to be mounted in the cabinet 10 at one side thereof such that the air supplying device 50 is separated from the accommodating space 20 by a partition 40. This is because clothes are prevented from being directly exposed to and thus damaged by a high heat generating part, e.g., a heat exchanging part, of the air supplying device 50, and the clothes are prevented from being wetted by condensed water, generated by the operation of the air supplying device 50.

In this embodiment, therefore, it is preferred to provide a machinery room 30, which is separated from the accommodating space 20 by the partition 40, at the lower part of the cabinet 10 and to install the air supplying device 50 inside the machinery room 30, to prevent condensed water, generated from the air supplying device 50, from dropping to the clothes, considering the center of gravity of the clothes treating apparatus. However, this structure is merely an example, and it is obvious that the present invention is not limited by the installation position of the air supplying device 50.

When the air supplying device 50 is installed such that the air supplying device 50 is separated from the accommodating space 20 as described above, it is preferred to provide a flow channel through which air heated by the air supplying device 50 is supplied into the accommodating space 20.

In this embodiment, therefore, it is preferred to provide a circulation duct 80 for connecting the heat exchanging part of the air supplying device 50 and a supply hole 60 formed at one side of the accommodating space 20, and to provide a passage, such as a discharge port 70, through which air is discharged from the accommodating space 20 to the air supplying device 50. The circulation duct 80 and the discharge port 70 form a circulation channel.

At this time, the circulation duct 80 is preferably formed along the rear side of the accommodating space 20. Generally, the capacity of clothes that can be received in the clothes treating apparatus is decided by the longitudinal length of the accommodating space 20. This is necessary to sufficiently secure the width of the accommodating space 20.

In this embodiment, therefore, the supply hole 60 is formed at a rear wall 15 of the accommodating space 20, and the circulation duct 80 connects the discharge port 70, the air supplying device 50, and the supply hole 60 to form a path along which heated air flows. However, the installation position of the circulation duct 80 is merely a preferred example, and therefore, the circulation duct 80 may be installed at other different positions.

Meanwhile, in the above-described stricture, there is a possibility that heated dry air, generated by the air supplying device 50, may be supplied to the supply hole 60 only in a specific direction. That is, when hot air is supplied by a blowing unit 90, such as a fan, heated dry air (hereinafter, also referred to as 'hot air') may be supplied through the supply hole 60 only in the horizontal direction, but the hot air may not be supplied in the lateral directions or the upward and downward directions of the supply hole 60. Therefore, embodiments which will be described in the following include a guide unit for uniformly supplying hot air into the accommodating space 20 such that the hot air is not supplied intensively to one side of the accommodating space 20. The guide unit will be described in detail with reference to the accompanying drawings.

Figure 3:
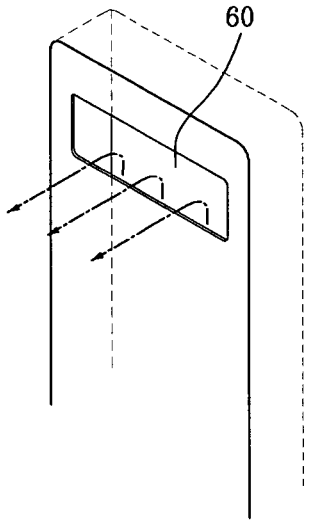
FIG. 3 is a schematic view illustrating a path along which hot air is dispersed without the provision of a guide unit according to this embodiment.

FIG. 3 is a schematic view illustrating a path along which hot air supplied through the supply hole 60 is dispersed without the provision of the guide unit.

Referring to FIG. 3, hot air heated by the air supplying device 50 is moved along the circulation duct 80 by the blowing unit 90. Also, the hot air is supplied into the accommodating space 20 through the supply hole 60 of the accommodating space 20.

At this time, the hot air is forced to flow at a predetermined velocity by the blowing unit 90, and has a velocity component in a regular direction according to the shape of the circulation duct 80 while passing through the circulation duct 80. Consequently, when the hot air is discharged into an open space through the supply hole 60, the hot air has a tendency to flow in a specific direction according to the velocity component while passing through the circulation duct 80.

That is, when the circulation duct 80 and the supply hole 60 are formed as shown in FIG. 3, the hot air introduced through the supply hole 60 is dispersed in the horizontal direction, but the hot air is not supplied in the opposite lateral directions of the supply hole 60 or in the upward and downward directions of the supply hole 60. In this embodiment, the hot air passes through the duct 80, which is vertically formed, and is then discharged through the supply hole 60. This is because, when the hot air is discharged, the hot air does not include any velocity components progressing in the left and right directions of the supply hole 60. Consequently, clothes received in the front of the supply hole 60 are smoothly treated by the hot air, whereas clothes received at the opposite lateral sides of the supply hole 60 may not be properly treated by the hot air.

For this reason, the clothes treating apparatus according to this embodiment includes a guide unit 100 for adjusting the path of the hot air supplied through the supply hole 60 to uniformly disperse the hot air into the accommodating space.

Figure 4:
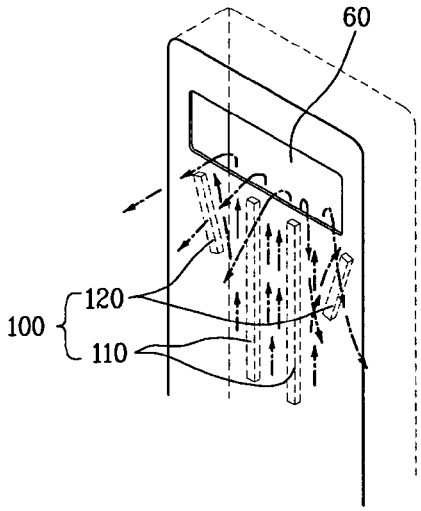
FIG. 4 is a perspective view schematically illustrating the stricture of a first embodiment of the guide unit.

FIG. 4 is a perspective view schematically illustrating the structure of a first embodiment of the guide unit.

Referring to FIG. 4, the guide unit 100 includes a plurality of guide ribs 110 and 120 formed at the inner wall of the circulation duct 80 in a protruding shape for defining a path along which hot air advances inside the circulation duct 80. Specifically, the guide ribs 110 and 120 provide the hot air passing through the circulation duct 80 with velocity components in predetermined directions according to the shape of the guide ribs 110 and 120 and the direction in which the guide ribs 110 and 120 are installed at the circulation duct 80. Consequently, it is possible to guide the hot air such that the hot air is discharged into the accommodating space in a predetermined direction while the hot air passes through the supply hole 60. In particular, in this embodiment, the guide ribs 110 and 120 are constricted in a structure in which when the hot air is introduced into the accommodating space 20 through the supply hole 60, the hot air can be dispersed not only in the front of the supply hole 60 but also in the left and right directions of the supply hole 60.

That is, the guide ribs 110 and 120 are installed at a predetermined angle to the direction in which the circulation duct 80 is installed. Consequently, the hot air advancing along the circulation duct 80 may have a horizontal velocity component while passing by the parts where the guide ribs 110 and 120 are installed. Here, the velocity component of the hot air may be changed depending upon the angle between the guide ribs 110 and 120 and the direction in which the circulation duct 80 is installed. Consequently, it is preferred to provide an angle required according to the shape of the accommodating space 20 and the installation position of the guide ribs 110 and 120.

At this time, it is preferred for the guide ribs 110 and 120 to be installed adjacent to the supply hole 60. This is because, although the hot air includes a velocity component in a predetermined direction while passing by the guide ribs 110 and 120, the velocity component of the hot air in the predetermined direction may be weakened when the hot air advances through a predetermined section of the circulation duct where the guide ribs 110 and 120 are not installed.

In this embodiment, therefore, it is preferred for the guide ribs 110 and 120 to be mounted at the inner wall of the circulation duct 80 adjacent to the supply hole 60 such that the hot air can be directly discharged into the accommodating space through the supply hole 60 while the velocity component of the hot air is provided by the guide ribs 110 and 120.

Meanwhile, the guide ribs 110 and 120 may be constricted in a single or plural rib stricture. In this embodiment, however, it is preferred to construct the guide ribs 110 and 120 in the plural rib structure. This is because, when the guide ribs 110 and 120 are constructed in the plural rib stricture, it is possible to guide the hot air passing through the circulation duct such that the hot air has velocity components in various directions.

Figure 5:
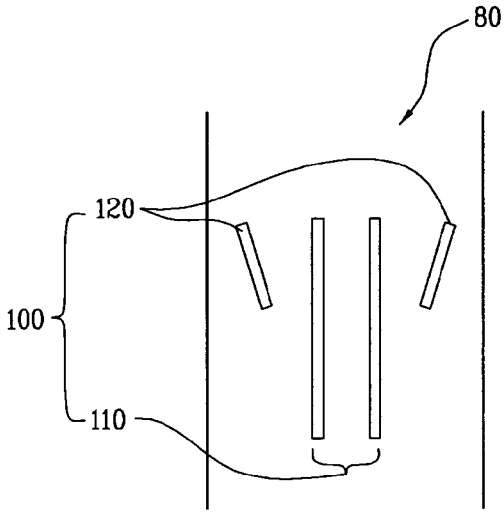
FIG. 5 is a front view schematically illustrating the arrangement of guide ribs in FIG. 4.

FIG. 5 is a front view schematically illustrating the arrangement of the guide ribs in FIG. 4.

Referring to FIG. 5, the guide ribs 110 and 120 of this embodiment include first ribs 110 formed in parallel to the direction in which the circulation duct 80 is installed and second ribs 120 formed at the outsides of the respective first ribs 110 such that the second ribs 120 are inclined outward in the advancing direction. In this embodiment, hot air flowing along the circulation duct 80 forms respective flow channels according to the parts where the guide ribs 110 and 120 are installed.

Here, the hot air passing between the first ribs 110 is discharged into the accommodating space 20 through the support port 60, and advances in front of the support part 60. For the hot air passing by the outsides of the respective first ribs 110, particularly the hot air passing between the first ribs 110 and the corresponding second ribs 120, their flow channels are changed such that the hot air flows in the left and right directions. Consequently, the hot air is discharged into the accommodating space 20 while the hot air has the left- and right-direction velocity components.

In this embodiment, therefore, it is possible for the hot air passing through the circulation duct 80 and discharged through the support port 60 to be uniformly dispersed not only in front of the support port 60 but also in the left and right direction of the support port 60.

Here, the shape of the guide ribs 110 and 120 of this embodiment is merely an example, and therefore, the present invention is not limited to the illustrated shape of the guide ribs.

Figure 6:
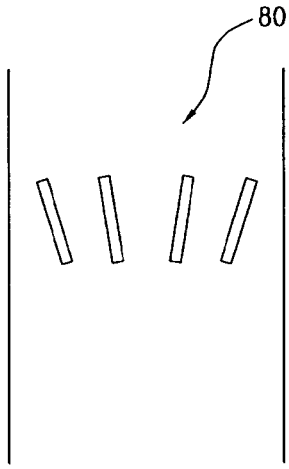
FIG. 6 is a front view illustrating a modification in which the arrangement of the guide ribs shown in FIG. 5 is changed.

FIG. 6 is a front view illustrating a modification in which the arrangement of the guide ribs shown in FIG. 5 is changed.

Referring to FIG. 6, the guide ribs may include two pairs of ribs inclined in the left and right directions, respectively, although the shape is not particularly restricted so long as the guide ribs are configured to uniformly disperse the hot air into the accommodating space.

Figure 7:
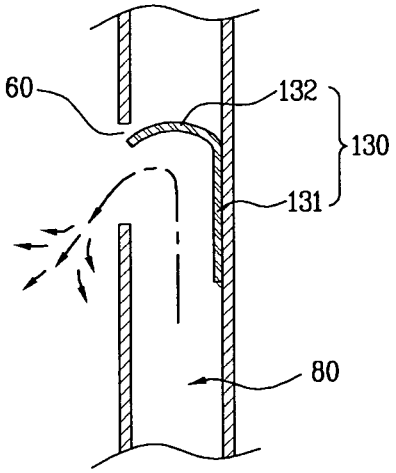
FIG. 7 is a side sectional view schematically illustrating the stricture including a guide member for guiding hot air to be supplied into the lower part of a accommodating space in FIGS. 5 and 6.

FIG. 7 is a side sectional view schematically illustrating a guide member for guiding hot air downward through the supply hole.

Generally, hot air has density lower than that of the surrounding air and thus exhibits a rising tendency. Consequently, when hot air, heated by the air supplying device 50, is supplied into the accommodating space 20, the hot air, having a relatively high temperature, is discharged through the supply hole 60 and, at the same time, is dispersed upward. In this case, there is a problem in that the effect of clothes improvement by the hot air may not be made on clothes located at the lower part of the accommodating space 20.

That is, the previous embodiment is characterized in that the hot air is uniformly dispersed into the accommodating space 20 in the horizontal direction, whereas an embodiment which will be described in the following is characterized in that the guide unit is provided to guide the hot air such that the hot air can be uniformly dispersed not only in the horizontal direction but also in the vertical direction.

Meanwhile, this embodiment is characterized in that the shape of the guide unit is changed and the direction in which the hot air is guided by the guide unit is changed as compared with the previous embodiment. Consequently, the technical characteristics of the previous embodiment are similarly applicable to this embodiment. However, the similar technical characteristics will not be described in order to avoid the repetition.

Figure 8:
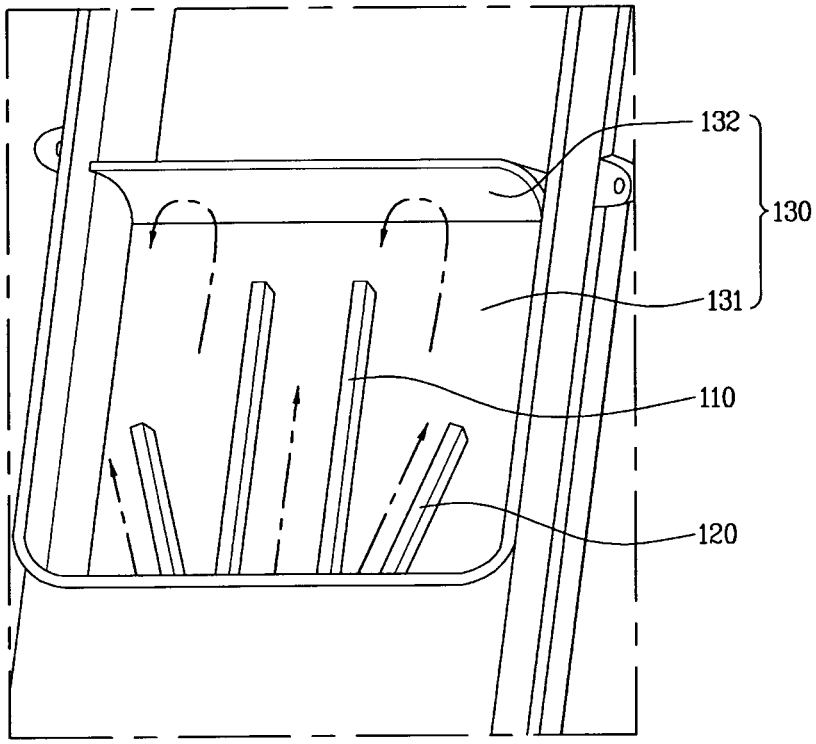
FIG. 8 is a perspective view of FIG. 7.

FIG. 7 is a side sectional view schematically illustrating the structure including a guide member for guiding hot air to be supplied downward, and FIG. 8 is a perspective view of FIG. 7.

Referring to FIGS. 7 and 8, it is preferred for this embodiment to include a guide member 130 for guiding hot air, supplied through the supply hole 60, such that the hot air can be discharged into the lower part of the accommodating space 20. At this time, it is preferred for the guide member 130 to be mounted at the inner wall of the circulation duct 80. Also, it is preferred for the guide member 130 to be located adjacent to the supply hole 60.

Here, it is preferred for the guide member 130 to include a part gently bent forward to naturally change a path along which the hot air passing through the circulation duct flows. Specifically, the guide member 130 includes a coupling part 131 fixed to the inner wall of the circulation duct 80 and a guide part 132 for changing the advancing direction of the hot air.

The coupling part 131 is fixed to the inner wall of the circulation duct 80 by a fastening member for supporting the guide member 130. The guide part 132 is gently bent forward from the coupling part 131 for guiding the path of the hot air.

At this time, it is preferred for the end of the guide part 132, which decides the final advancing direction of the hot air, to be gently bent such that the end of the guide part 132 is gradually directed downward toward the supply hole 60. Consequently, the hot air entering the supply hole 60 through the guide member 130 is discharged into the lower part of the accommodating space. Meanwhile, the end of the guide part 132 may be located at just the rear side of the supply hole 60. Alternatively, a portion of the end of the guide part 132 may be exposed by a predetermined length through the supply hole 60.

In this embodiment, the hot air rises from the lower part to the upper part of the accommodating space 20 due to the rising tendency of the hot air, after the hot air is introduced into the lower part of the accommodating space 20. Consequently, the hot air is uniformly dispersed at the upper and lower parts of the accommodating space 20. Also, the circulation of air in the accommodating space 20 is smoothly performed by the hot air discharged downward. Consequently, when the hot air is supplied and, at the same time, steam is sprayed or a perfuming process is carried out, the steam and an aromatic may be uniformly sprayed throughout the accommodating space 20.

As shown in FIG. 8, on the other hand, the first ribs 110 and the second ribs 120 of the previous embodiment may be also provided together with the guide member 130. In this case, the hot air, passing between the guide ribs 110 and 120 and the guide member 130, is more uniformly dispersed horizontally and vertically into the accommodating space 20. Consequently, it is possible to provide a clothes treating apparatus that has uniform clothes treating environment.

Figure 9:
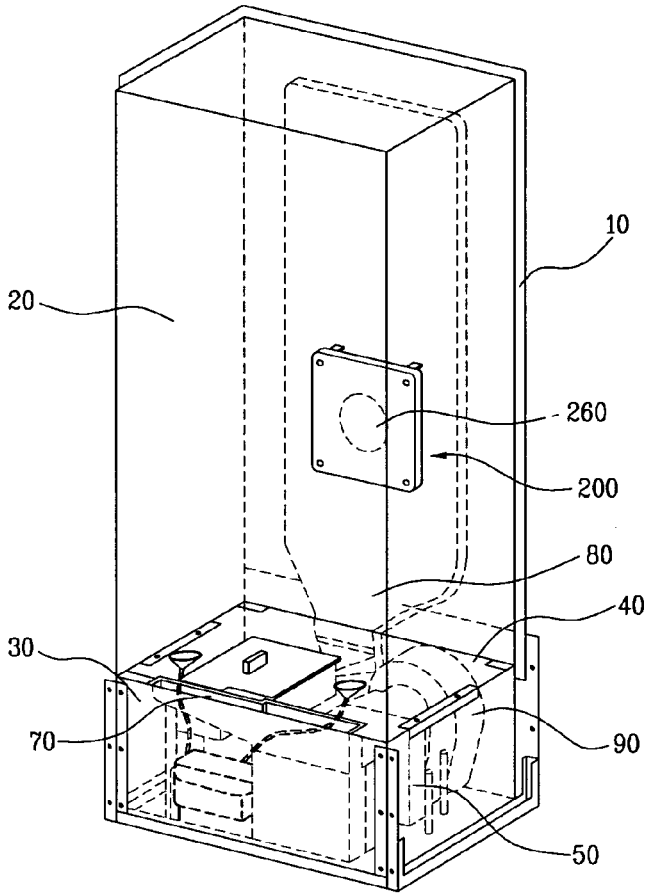
FIG. 9 is a perspective view illustrating the interior structure of a clothes treating apparatus according to a second embodiment of the present invention.
Figure 10:
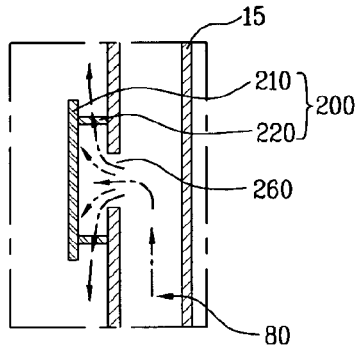
FIG. 10 is a sectional view illustrating a guide unit in FIG. 9.

FIG. 9 is a perspective view illustrating the interior structure of a clothes treating apparatus according to a second embodiment of the present invention, and FIG. 10 is a sectional view illustrating a guide unit in FIG. 9. This embodiment is different from the previous embodiments with respect to the structure of a guide unit for uniformly dispersing hot air supplied through the supply hole into the accommodating space. The present invention will be described hereinafter based on the difference.

Referring to FIGS. 9 and 10, the guide unit according to the second embodiment includes a guide plate 210 spaced a predetermined distance from a supply hole 260 formed at the inside of the accommodating space 20.

In this embodiment, as shown in FIG. 10, hot air introduced through the supply hole 260 collides with the guide plate 210, with the result that the horizontal-direction velocity component of the hot air is lost. Consequently, the hot air collides with the guide plate 210, with the result that the path along which the hot air flows is curved. After that, the hot air is dispersed into the accommodating space 20 through a space between the guide plate 210 and the inside of the accommodating space 20. That is, the hot air discharged through the supply hole 260 collides with the guide plate 210, with the result that the path along which the hot air flows is curved, and is then discharged into the accommodating space 20 along all the boundaries, i.e., the upper and lower boundaries and the left and right boundaries, of the guide plate 210. As a result, the hot air is uniformly dispersed into the accommodating space 20.

In this case, the hot air discharged into the accommodating space is not directly supplied to clothes. The hot air primarily collides with the guide plate 210, and is then dispersed into the accommodating space 20 in which the clothes are received. Consequently, it is also possible to prevent the clothes received in the accommodating space 20 from being directly exposed to strong hot air.

More specifically, it is preferred for the guide plate 210 according to this embodiment to be fixed by fixing ribs 220 such that the guide plate 210 can be spaced a predetermined distance from the supply hole 260 formed at the rear wall 15 of the accommodating space 20.

At this time, the guide plate 210 may be mounted substantially in parallel to the rear wall of the accommodating space 20. With this stricture, it is possible to provide an esthetically pleasing external appearance, to supply the hot air in all directions of the guide plate 210, and to more widely secure the space for receiving the clothes. When the hot air is required to be guided in a specific direction, however, the guide plate 210 may be mounted such that the guide plate 210 is inclined at a predetermined angle to the rear wall of the accommodating space.

Meanwhile, the guide plate 210 may be formed in various shapes in consideration of its esthetically pleasing external appearance. However, it is preferred for the guide plate 210 to have an area larger than that of the supply hole 260 such that the guide plate 210 can cover the supply hole 260 in front of the supply hole 260. With this stricture, it is possible to prevent the hot air supplied through the supply hole 260 from being directly supplied to the clothes. Also, the supply hole 260 is not exposed when viewing from the outside at the time of receiving clothes, with the result that the clothes treating apparatus has an esthetically pleasing appearance. In addition, it is possible to prevent the introduction of external foreign matter into the supply hole 260 and thus the breakdown of the clothes treating apparatus.

Generally, however, hot air has a rising tendency. For this reason, although the hot air collides with the guide plate 210 and is then dispersed in all directions, the amount of the hot air supplied into the accommodating space through the upper edge of the guide plate 210 may be greater than the amount of the hot air supplied into the accommodating space through the lower edge of the guide plate 210. Consequently, it is preferred to provide a structure in which the hot air is supplied into the lower part of the accommodating space. This structure will be described with reference to a drawing.

Figure 11:
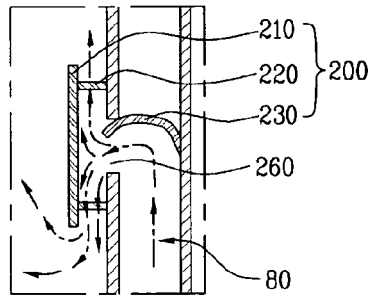
FIG. 11 is a side sectional view schematically illustrating the structure including a guide member for guiding hot air to be supplied into the lower part of a accommodating space in FIG. 10.

FIG. 11 is a side sectional view schematically illustrating the structure including a guide member 230 for guiding hot air to be supplied into the lower part of the accommodating space. The guide member 230 is similar in construction to the previously described guide member of FIGS. 7 and 8, and therefore, a repetitive description will not be given.

When the hot air is guided into the lower part of the accommodating space 20 by the guide member 230, the hot air rises after the hot air is supplied into the accommodating space through the lower edge of the guide plate 210. Consequently, it is possible to uniformly disperse the hot air from the lower part to the upper part of the accommodating space.

Meanwhile, although not shown, through-holes are formed at a predetermined region of the guide plate 210 such that some of the hot air supplied through the supply hole 260 is directly supplied into the accommodating space through the through-holes without the collision between the hot air and the guide plate 210. Of course, the guide plate 210 of this embodiment is provided to prevent the supply of the hot air in a specific direction. Consequently, it is preferred to provide a plurality of small-sized through-holes to coincide with the purpose of this embodiment. For example, the guide plate 210 may be provided with a plurality of through-holes (not shown) formed symmetrically about the support hole in different directions.

In this way, it is possible for the clothes treating apparatus according to this embodiment to uniformly supply hot air into the accommodating space 20 and to prevent clothes from being directly exposed to high-temperature hot air. However, the guide plate 210 is not restricted to the above-described shape, and therefore, it is possible to modify the guide plate 210 in various shapes within a scope in which the technical idea of the present invention can be implemented.

Figure 12:
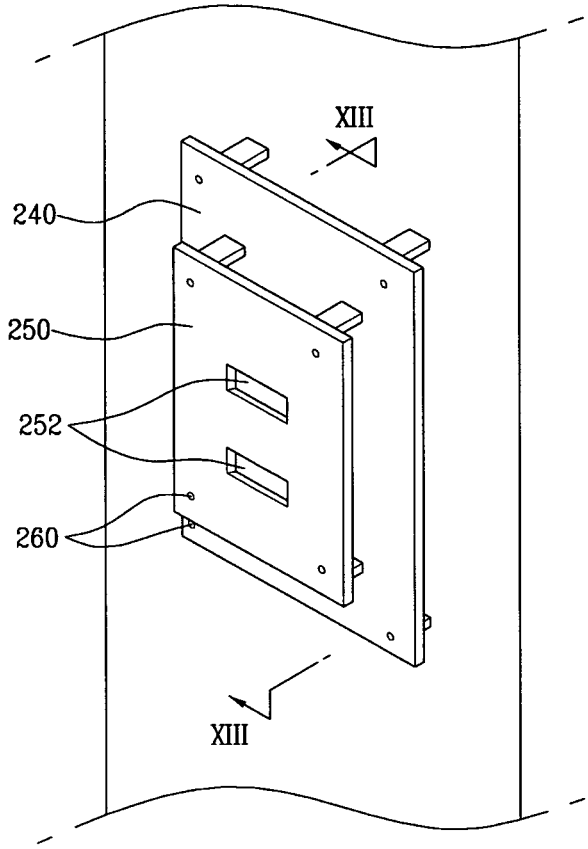
FIG. 12 is a perspective view illustrating the stricture of a guide unit according to a modification of the second embodiment.
Figure 13:
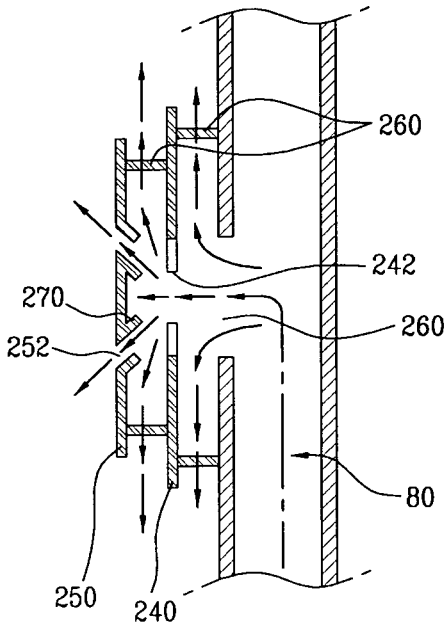
FIG. 13 is a sectional view taken along line XIII-XIII of FIG. 12.

FIG. 12 is a perspective view illustrating the structure of a guide unit according to a modification of the second embodiment, and FIG. 13 is a sectional view taken along line XIII-XIII of FIG. 12. The guide unit according to the modification is different from the embodiments of FIGS. 10 and 11 in that the guide unit according to the modification further includes a sub plate spaced a predetermined distance from the guide plate. The present invention will be described hereinafter based on the difference.

Referring to FIGS. 12 and 13, the guide unit according to this modification may include a plurality of plates 250 and 240. At this time, it is preferred for the plates 250 and 240 to be mounted such that the plates 250 and 240 are spaced apart from each other to form a layer-type structure.

Specifically, the guide unit according to this embodiment may include a sub plate 250 and a guide plate 240. At this time, the sub plate 250 may be mounted by fixing ribs 260 mounted to the guide plate 240, and the guide plate 240 may be mounted by fixing ribs 260 mounted at the rear wall of the accommodating space.

Here, it is preferred for the guide plate 240 to have an opening hole 242 formed at a position corresponding to the installation position of the supply hole 260 of the rear wall such that hot air introduced through the supply hole collides with the sub plate 250 with the result that the hot air is dispersed.

In this embodiment, therefore, some of the hot air supplied through the supply hole 260 collides with the guide plate 240, and is then supplied into the accommodating space 20 through the edge of the guide plate 240. The remaining hot air advances toward the sub plate 250 through the opening hole 242 of the guide plate 240. The hot air advancing toward the sub plate 250 collides with the sub plate 250, with the result that the hot air is supplied into the accommodating space 20 through the edge of the sub plate 250. When through-holes 252 and dispersing parts 270 are formed at the front of the sub plate 250, as in this embodiment, it is possible for some of the hot air to be supplied into the accommodating space 20 through the through-holes 252 by the dispersing parts 270.

Here, the dispersing parts 270 are structures formed at the sub plate 250 for guiding the hot air such that the hot air passing through the through-holes 252 advances into the accommodating space 20 in a desired direction.

In this embodiment, as described above, it is possible to more diversifying the path along which the hot air advances into the accommodating space 20, with the result that the hot air is uniformly dispersed into the accommodating space 20.

Figure 14:
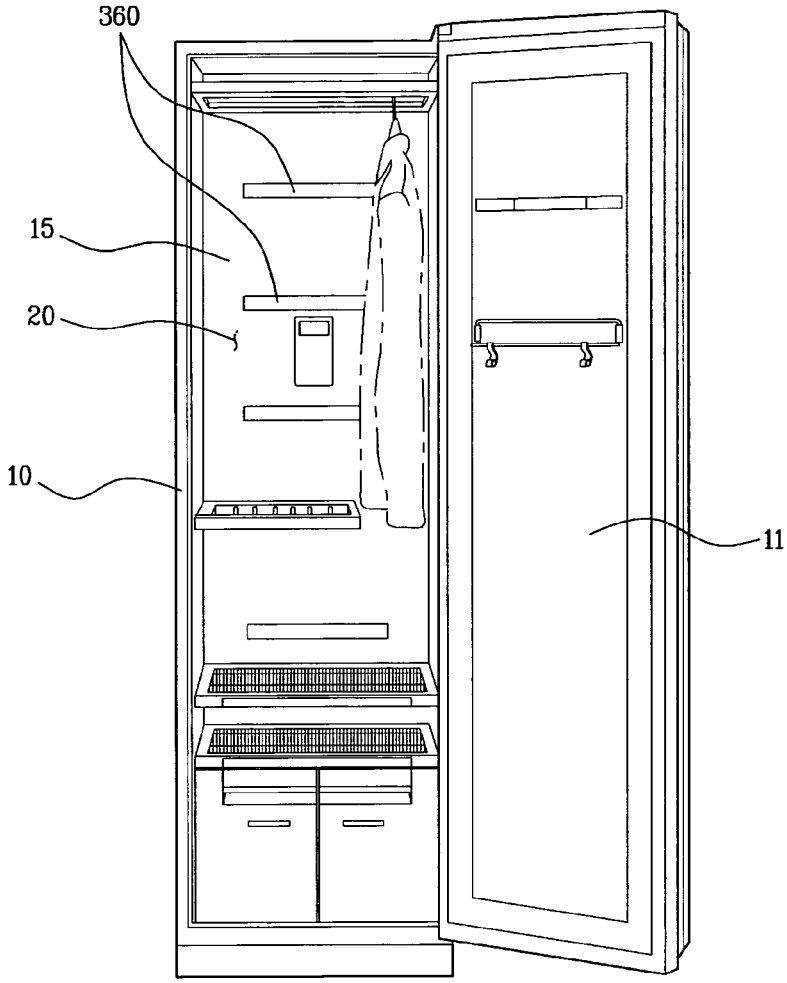
FIG. 14 is a front view illustrating a clothes treating apparatus according to a third embodiment of the present invention.
Figure 15:
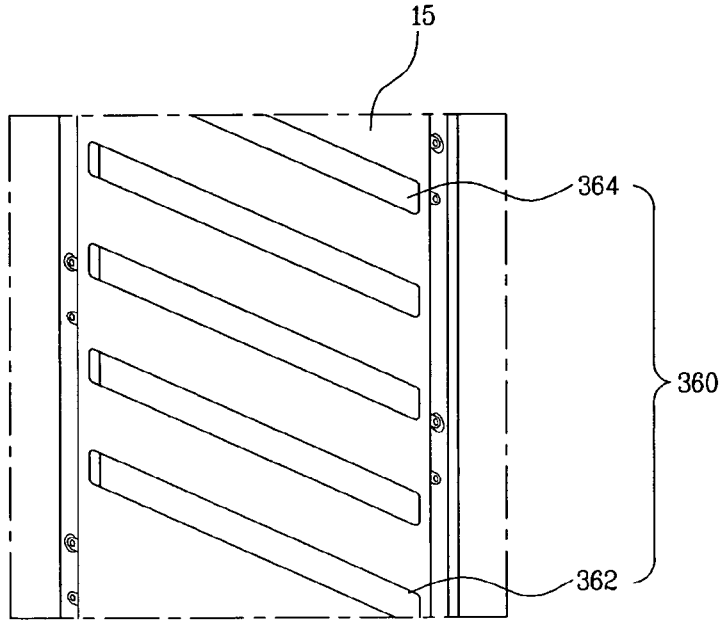
FIG. 15 is a perspective view illustrating the rear of the clothes treating apparatus shown in FIG. 14.

FIG. 14 is a front view illustrating a clothes treating apparatus awarding to a third embodiment of the present invention, and FIG. 15 is a perspective view illustrating the rear of the clothes treating apparatus shown in FIG. 14. This embodiment is different from the previous embodiments in that a guide unit for uniformly supplying hot air is provided in a stricture in which a plurality of supply holes are provided for supplying the hot air into the accommodating space. The present invention will be described hereinafter based on the difference.

Referring to FIGS. 14 and 15, supply holes 360 are formed at the rear 15 of the accommodating space 20 for supplying hot air heated by the air supplying device into the accommodating space 20. As previously described, the machinery room 20 is located below the accommodating space 20. Consequently, although not shown, the circulation duct 80 may be vertically formed at the inside of the rear 15. That is, the circulation duct is formed vertically along the inside of the rear 15 in the machinery room 20. Consequently, as shown in FIG. 15, the supply holes are formed along the circulation duct in the direction vertical to the rear 15.

When the hot air is supplied in the above-described structure, there is a problem in that the hot air is not uniformly supplied through the supply holes 360. That is, the amount of the hot air supplied through the lowermost supply hole 362, i.e., the supply hole 362 adjacent to the machinery room 20, is different from the amount of the hot air supplied through the uppermost supply hole 364, i.e., the supply hole 364 remote from the machinery room 20.

Since the lowermost supply hole 362 is formed adjacent to the machinery room 20, the lowermost supply hole 362 supplies a larger amount of hot air than the uppermost supply hole 364. That is, since a larger amount of hot air is supplied through the lowermost supply hole 362 than the uppermost supply hole 364, it is difficult to uniformly dry clothes. Furthermore, time necessary for drying the clothes increases.

In this embodiment, therefore, fixing plates for guiding hot air to be uniformly supplied through the plurality of supply holes 360 are provided in a stricture in which the hot air is supplied into the accommodating space 20 through the supply holes 360.

Figure 16:
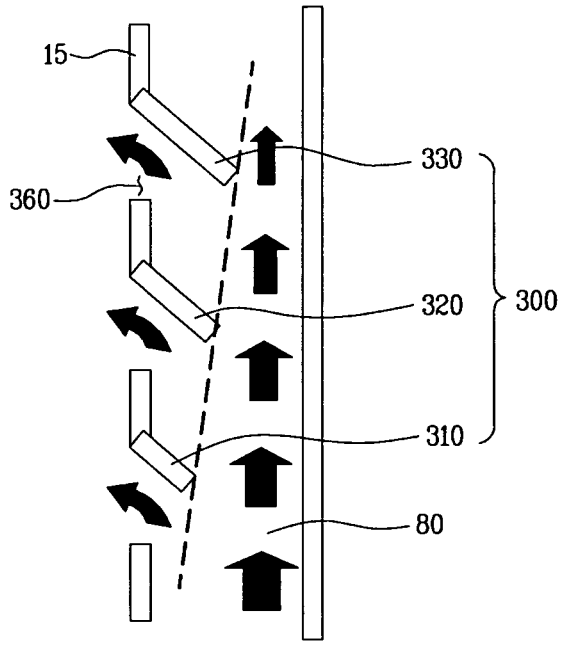
FIG. 16 is a sectional view illustrating a preferred stricture of fixing plates.

FIG. 16 is a sectional view illustrating a preferred structure of the fixing plates.

Referring to FIG. 16, the clothes treating apparatus according to this embodiment is constructed in a stricture in which the fixing plates 300 are formed along flow channels along which hot air flows. Specifically, the fixing plates 300 are formed adjacent to the supply holes 360 such that the fixing plates 300 protrude toward the flow channels. Consequently, hot air flowing along the circulation duct 80 is guided to the supply holes 360 by the fixing plates 300, and is then supplied into the accommodating space 20. In this case, it is preferred for the fixing plates 300 to be inclined to more easily guide the hot air. Preferably, the fixing plates are inclined in the direction in which the hot air is blown. Specifically, it is preferred for the fixing plates to be inclined downward as shown in FIG. 17. However, the inclination angle of the fixing plates 300 is not particularly restricted. For example, the fixing plates 300 may have an inclination angle of 10 to 70 degrees.

Meanwhile, it is preferred for the fixing plates 300 to have different lengths. This is because, when the lengths of the fixing plates 300 are the same, it is not possible to solve the problem that the hot air is not uniformly supplied through the supply holes 360. In this embodiment, therefore, the fixing plates 300 have different lengths. Preferably, the lengths of the fixing plates 300 are decided depending upon the distance between the fixing plates and the air supplying device along the circulation dint 80.

That is, as shown in FIG. 16, it is preferred that the closer the fixing plates 300 are adjacent to the air supplying device, the shorter the lengths of the fixing plates 300 are, and the more the fixing plates 300 are distant from the air supplying device, the longer the lengths of the fixing plates 300 are. FIG. 16 illustrates three fixing plates 310, 320, and 330, as an example of the fixing plates 300. The length of the lowermost fixing plate 310, which is adjacent to the air supplying device, is the smallest. As the fixing plates 320 and 330 are located highly, i.e., the fixing plates 320 and 330 are further distant from the air supplying device, the lengths of the fixing plates 320 and 330 increase. As a result, the uppermost fixing plate 330 has the largest length. In this way, the hot air, flowing along the circulation duct 80, is uniformly supplied into the accommodating space 20 through the respective supply holes 360 by the fixing plates 300, with the result that it is possible to uniformly dry clothes. Consequently, it is possible to reduce the drying time.

Meanwhile, although not shown, a moisture supplying device for selectively supplying moisture into the accommodating space 20 may be mounted in the machinery room 30. For example, the moisture supplying device may be implemented by a steam generator for supplying steam. It is possible to remove wrinkles from clothes by supplying steam into the accommodating space 20 by the steam generator. Furthermore, the sterilizing effect by the high-temperature steam and the refresh effect by the swelling of the clothes are achieved. The timing when the steam is sprayed by the steam generator may be appropriately changed. It is preferred for the steam generator to spray the steam before hot air is supplied by the air supplying device. This is because the supply of the hot air to dry the clothes after the spray of the high-temperature steam is preferred.

In the steam generator is mounted a heater (not shown) for heating water in the steam generator. The heater heats the water to generate steam, which is supplied into the accommodating space 20. An external facet or a container provided at one side of the machinery room 30 may be used as a water supply source for supplying water into the steam generator. Preferably, the container is detachably mounted in the machinery room such that a user can separate the container from the machinery room 30, fill the container with water, and mount the container in the machinery room 30. Also, the steam generated by the steam generator is supplied into the accommodating space 20. In this case, it is preferred to shorten the flow length of the steam to prevent the temperature of the steam from lowering or the steam from condensing during the flow of the steam. Consequently, when the machinery room 30 is located below the accommodating space 20, it is preferred for a steam nozzle (not shown) to supply the steam through the top of the machinery room 30, i.e., the bottom of the accommodating space 20.

Hereinafter, the operation of the clothes treating apparatus with the above-stated construction will be described.

When the clothes treating apparatus is driven, water from the water supply source is supplied to the steam generator, by which steam is generated, and the generated steam is sprayed into the accommodating space 20. As a result, wrinkles are removed from clothes. Furthermore, the sterilizing effect and the swelling effect are also achieved.

After the steam is sprayed for a predetermined time, hot air is supplied by the air supplying device. In this case, the heated air is uniformly supplied into the accommodating space 20 by the above-described guide unit. As a result, it is possible to uniformly dry the clothes using the uniformly supplied hot air and thus reduce the drying time. After the clothes are dried using the hot air, the supply of hot air is terminated, and therefore, the clothes refreshing process is completed.

The invention claimed is:

1. A clothes treating apparatus comprising:

a cabinet having an accommodating space for accommodating clothes;

an air supplying device for drying air circulating into the accommodating space;

at least one supply hole formed at each side surface of the accommodating space or a rear side surface of the accommodating space for allowing the dry air to be supplied therethrough;

a circulation duct communicating with the at least one supply hole to define a path along which dry air flows; and a guide unit for guiding dry air generated by the air supplying device to be uniformly dispersed into the accommodating space, wherein the guide unit includes a plurality of guide ribs provided inside the circulation duct such that the dry air passing by the guide ribs has a horizontal velocity component for horizontally dispersing the dry air flowing along the circulation duct through the at least one supply hole.

2. The clothes treating apparatus according to claim 1, wherein the guide ribs are provided adjacent to the at least one supply hole.

3. The clothes treating apparatus according to claim 2, wherein at least some of the guide ribs are inclined at a predetermined angle to the direction in which the circulation duct is disposed.

4. The clothes treating apparatus according to claim 2, wherein at least some of the guide ribs are provided such that the distance between the neighboring guide ribs is increased.

5. The clothes treating apparatus according to claim 2, further comprising:

a guide member for guiding the dry air flowing along the circulation duct to be supplied to the at least one supply hole.

6. The clothes treating apparatus according to claim 5, wherein the guide member is provided in the circulation duct and adjacent to the at least one supply hole, the guide member being bent toward the at least one supply hole.

7. A clothes treating apparatus comprising:

a cabinet having a accommodating space for accommodating clothes;

an air supplying device for drying air circulating into the accommodating space;

at least one supply hole formed at each side surface of the accommodating space or a rear side surface of the accommodating space for allowing the dry air to be supplied therethrough;

a circulation duct communicating with the at least one supply hole to define a path along which dry air flows; and a guide unit for guiding dry air generated by the air supplying device to be uniformly dispersed into the accommodating space, wherein the guide unit includes a guide plate provided in front of the at least one supply hole such that the guide plate is spaced a predetermine distance from the at least one supply hole, and the dry air supplied through the at least one supply hole is dispersed into the accommodating space through a space defined between the guide plate and the inside of the accommodating space.

8. The clothes treating apparatus according to claim 7, wherein the guide plate has a size greater than that of the at least one supply hole.

9. The clothes treating apparatus according to claim 8, wherein the guide plate is provided to be parallel to the inside of the cabinet where the at least one supply hole is formed.

10. The clothes treating apparatus according to claim 7, wherein the guide plate is provided at one side thereof with a through-hole.

11. The clothes treating apparatus according to claim 10, further comprising:

a sub plate spaced a predetermined distance from the through-hole of the guide plate, wherein the dry air passing through the through-hole is dispersed into the accommodating space through a space defined between the guide plate and the sub plate.

12. The clothes treating apparatus according to claim 11, wherein the sub plate is provided with a dispersing part for guiding the flow of the dry air passing through the through-hole.

13. The clothes treating apparatus according to claim 7, further comprising:

a guide member for guiding the dry air flowing along the circulation duct to be supplied to the at least one supply hole.

14. The clothes treating apparatus according to claim 13, wherein the guide member is provided in the circulation duct and adjacent to the at least one supply hole, the guide member being bent toward the at least one supply hole.

15. A clothes treating apparatus comprising:

a cabinet having a accommodating space for accommodating clothes;

an air supplying device for drying air circulating into the accommodating space; and a plurality of supply holes formed at each side surface of the accommodating space or a rear side surface of the accommodating space for allowing the dry air to be supplied therethrough;

a circulation duct communicating with the at least one supply hole to define a path along which dry air flows; and a guide unit for guiding dry air generated by the air supplying device to be uniformly dispersed into the accommodating space, wherein the guide unit includes a plurality of fixing plates provided at the respective supply holes to uniformly supply the dry air through the plurality of supply holes, and wherein the fixing plates are protruded inwardly of the circulation duct and have different lengths according to the distance between the fixing plates and the air supplying device along the circulation duct.

16. The clothes treating apparatus according to claim 15, wherein the lengths of the fixing plates are increased with the increase in distance between the fixing plates and the air supplying device.

17. The clothes treating apparatus according to claim 15, wherein the fixing plates are fixed such that the fixing plates are inclined at a predetermined angle to the air supplying device.

18. The clothes treating apparatus according to claim 1, further comprising:

a moisture supplying device for selectively supplying moisture into the accommodating space.

19. The clothes treating apparatus according to claim 18, wherein the moisture supplying device includes a steam generator for supplying steam into the accommodating space.

* * * * *